US010515403B1

(12) United States Patent
Allen

(10) Patent No.: US 10,515,403 B1
(45) Date of Patent: Dec. 24, 2019

(54) BID-BASED REQUESTS FOR ELECTRONIC RESOURCES

(71) Applicant: Amazon Technologies, Inc., Reno, NV (US)

(72) Inventor: Nicholas Alexander Allen, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 1460 days.

(21) Appl. No.: 13/826,972

(22) Filed: Mar. 14, 2013

(51) Int. Cl.
*G06Q 30/08* (2012.01)

(52) U.S. Cl.
CPC ..... *G06Q 30/08* (2013.01)

(58) Field of Classification Search
CPC .... G06Q 30/02; G06Q 30/08; G06Q 30/0206; G06Q 30/0224; G06Q 50/10; H04L 67/16; H04L 41/5054; H04L 47/783; H04W 4/02; H04W 4/206; H04W 88/02; G06F 3/011
USPC ..... 705/50
See application file for complete search history.

(56) References Cited

U.S. PATENT DOCUMENTS

2009/0030786 A1* 1/2009 Rosler ..... G06Q 30/02 705/14.13
2011/0143811 A1* 6/2011 Rodriguez ..... G06K 9/00986 455/556.1

* cited by examiner

*Primary Examiner* — Reginald R Reyes
(74) *Attorney, Agent, or Firm* — Hogan Lovells US LLP

(57) ABSTRACT

Shared electronic resources can be allocated to customers by auction when there is contention among the customers for the resources. Each customer can receive a bid pool for a shared electronic resource. A customer may prioritize a request by withdrawing a bid amount from the customer's bid pool and submitting the bid amount with a request for the shared resource. A resource provider may assess the capacity of the shared resource to process requests and conduct an auction at various times, such as during periods of congestion, to determine the requests that the shared resource will process at a given time. Customers can demand a refunded bid amount when the auction price is less than the customer's bid amount, and the customer can issue a repudiation challenge if no auction was held or the customer did not receive access to the shared resource.

25 Claims, 5 Drawing Sheets

BID-BASED REQUESTS FOR ELECTRONIC RESOURCES

BACKGROUND

As a growing number of applications and services are being made available over networks such as the Internet, an increasing number of content, application, and/or service providers are turning to technologies, such as cloud computing, that enable multiple users to share electronic resources. Access to these electronic resources is often provided through services, such as Web services, where the hardware and/or software used to support those services are dynamically scalable to meet the needs of the services at any given time. A user or customer typically will rent, lease, or otherwise pay for access to resources through the cloud, and thus does not have to purchase and maintain the hardware and/or software for these resources.

In some cloud computing or multi-tenant environments, a greater number of requests for access to shared electronic resources will be made at certain times than the resources can process, which may result in slow service or no service at all for users. One conventional approach for resolving contention among users for a shared resource is to limit the rate at which users can make requests or "throttle" user requests for the shared resource. Throttling, however, may be inflexible in certain circumstances. For example, a user may have an urgent request but a system that implements throttling may not allow the user to differentiate the priority of her request over other requests. Another conventional approach, which can be characterized as prioritization-based, may allow users to define the priority of their requests to a certain extent. For instance, users may be able to associate requests with varying levels of priority, and when there is contention for a shared resource, the resource provider can process a request according to the priority level corresponding with the request. Priority levels may be based upon any number of user-specifiable characteristics, such as the identity of the user (e.g., users may purchase guaranteed levels of service), processing requirements (e.g., requests with lower processing requirements may be given higher priority), or the type of the request (e.g., real-time sensitive requests, such as those relating to IP telephony or video-conferencing can be designated as higher priority). However, reasonable prioritization-based policies may be difficult to construct when there are many self-interested users. In addition, prioritization-based schemes may not be suitable when users are similarly situated and/or making similar types of requests.

BRIEF DESCRIPTION OF THE DRAWINGS

Various embodiments in accordance with the present disclosure will be described with reference to the drawings, in which.

DETAILED DESCRIPTION

Figure 1:
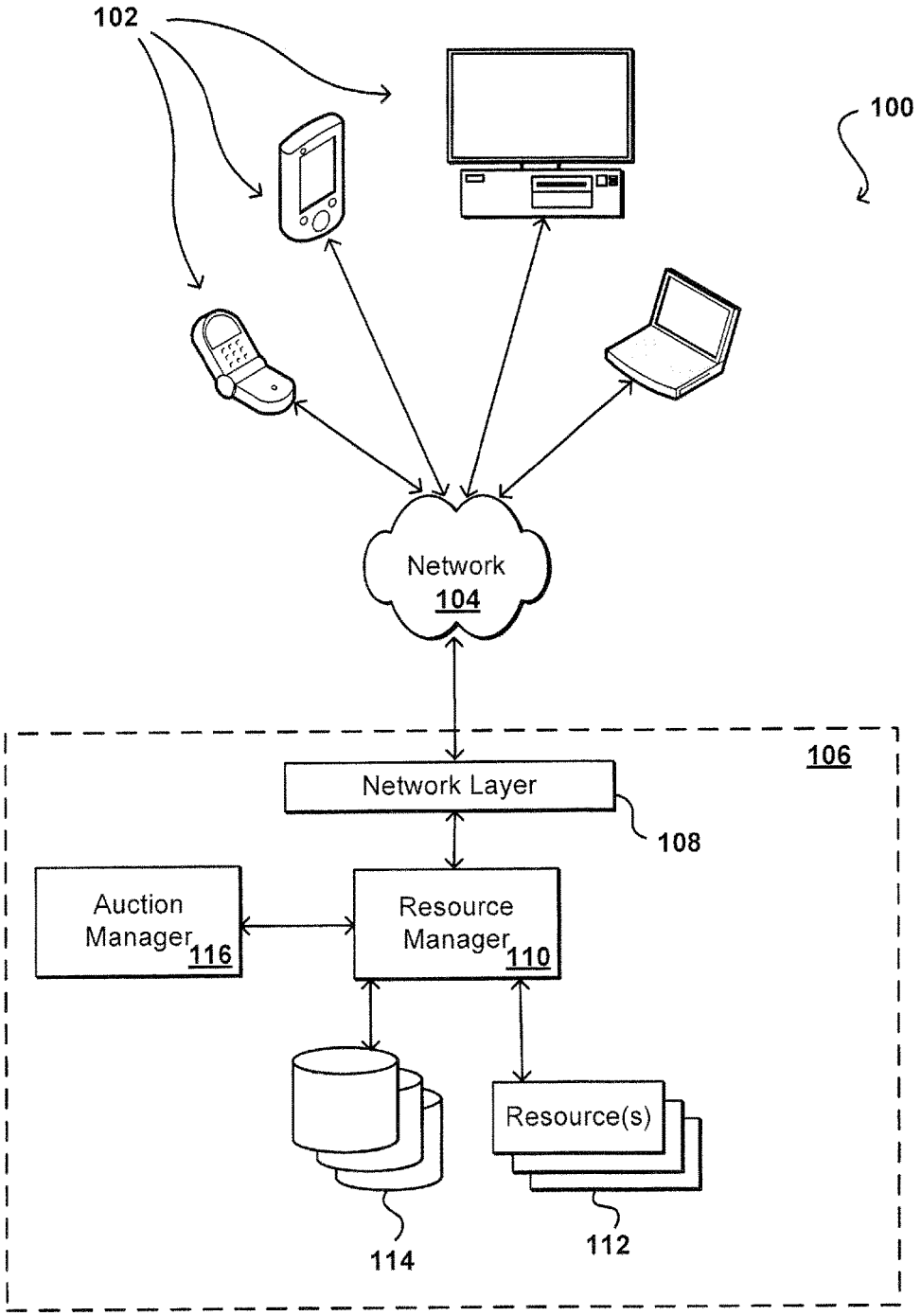
FIG. 1 illustrates an environment in which various embodiments can be implemented.

Systems and methods in accordance with various embodiments of the present disclosure overcome one or more of the aforementioned and other deficiencies experienced in conventional approaches to managing access to shared electronic resources. In particular, various embodiments utilize an auction-based approach for requesting of shared electronic resources from a service or resource provider. Customers (e.g., client devices, computing resources, applications, services, etc.) can each obtain a bid pool for bidding on requests for access to a shared resource. A customer may prioritize a request by withdrawing a bid amount from the customer's bid pool and submitting the bid amount with a request for the shared resource. A resource provider may assess the capacity of the shared resource to process requests and conduct an auction at various times, such as during periods of congestion, to determine the requests that the shared resource will process at a given time. The auction can be concluded when an auction price is determined, and those requests including bids greater than or equal to the determined auction price can be selected for processing by the shared resource.

In some embodiments, the auction can be implemented using a Vickrey auction or a variation thereof. In a Vickrey auction for a single item, the bidder with the highest bid wins and pays the second highest bid for the item. The Vickrey auction can be generalized for multiple items wherein the M bidders with the highest bids win and pay the $M+1^{St}$ highest bid, and each get one of the items. Approaches in accordance with various embodiments adapt the Vickrey auction for shared computing resources such that customers can negotiate an agreeable access order when there is contention for the shared resources. In one embodiment, the winning auction price may be based upon the smallest bid amount of a request selected for processing and the largest bid amount of an unselected request. For example, if five requests are received with bids of 0.00, 1.00, 2.00, 3.00, and 4.00, and it is determined that the shared resource can only process two requests at a particular time, the resource provider may determine the auction price to be 2.50, the midpoint between the bid amounts for the lowest selected request and the highest selected request. The resource provider may then select the requests with bid amounts of 3.0 and 4.0 for processing, and refund an amount of 0.50 and 1.50, respectively.

Approaches in accordance with various embodiments decentralize "currency" transactions and separate auctioning from committed currency withdrawals to reduce latency and round-trip communications. Currency may be virtual currency and/or can be associated with a governmental or intergovernmental monetary system (e.g., U.S. Dollar, Chinese Yuan, Euro). Currency may be referred to as tokens, virtual coins, or other quantifiable units to represent a customer's bid pool and bid values. A currency system can allow a customer to appraise the value of processing of the customer's request at a certain moment with respect to other customers who may be demanding processing of their own requests at that same moment. A customer who may have a less urgent request can elect to have the request processed during a period of less congestion. A customer who may have a critical request can withdraw an appropriate amount from the customer's bid pool to ensure processing of the request. Over time, access to a shared resource may become more evenly distributed using such approaches.

In some embodiments, validation of the use of currency or withdrawals and/or deposits to bid pools, such as to ensure that customers bid no more than the contents of their bid pools or to prevent double spending, can be performed primarily off-line. For example, in one embodiment, a customer may withdraw from the customer's bid pool by calculating a first signature for the previous contents of the bid pool, calculating a second signature for the new contents of the bid pool, creating an attestation that the bid pool has not changed from the first signature, and signing a transformation receipt based at least in part on the calculated signatures and attestation. The attestation may be created by, for example, having a trusted authority certify that it has not previously certified any signatures for the customer newer than the first signature. The trusted authority may require the customer to present a prior transformation receipt for the first signature if the trusted authority was not part of the prior certification. The trusted authority may record the second signature and henceforth refuse to certify any signatures older than the second signature. The trusted authority may be, for example, the resource provider, a third party trusted authority, other customers of the shared resource, or other customers of a shared multi-tenant environment.

In some embodiments, the resource provider may send a customer's request to other service or resource providers for additional processing. For example, in one embodiment, the customer may send a request to resource provider A, which in turn calls resource provider B to process the customer's request at least in part. Resource Provider A may attach the refunded bid amount to the call to resource provider B, receive a second refunded bid amount as a response from resource provider B, and return the second refunded bid amount to the customer. In another embodiment, the resource provider may arrange to collect only the maximum auction price along the request path. For instance, the auction price of resource provider A may be determined to be 4.00 and the auction price of resource provider B may be determined to be 3.00. Resource provider A may attach the originally received hash receipt on the call to resource provider B without modification, receive a refunded bid amount from the call to resource provider B, determine that the deducted bid amount of 3.00 from resource provider B is less than the auction price of 4.00 for resource A, and return the refunded bid amount to the customer less an additional deduction of 1.00.

In certain situations, a request may require extensive processing and a response may not be returned until the processing has been completed. Thus, the customer may not receive a refunded bid amount for a lengthy period of time. In other situations, a customer may have a disagreement over a refunded bid amount, or whether the customer's request was processed at all such that the customer demands full refund of a bid amount. Systems and methods in accordance with various embodiments can provide APIs or other such functions to handle these circumstances. One API may expedite provision of a refunded bid amount to the customer, and the workflow for such an API may ensure that the response to the processed request does not provide a double refund to the customer. Another API may allow the customer to challenge a refunded bid amount by passing a response from the resource provider including the disputed refunded bid amount. The resource provider may respond to such a repudiation challenge with a first hash receipt of another customer request with a bid amount that is less than or equal to the auction price and a second hash receipt of yet another customer request with a bid amount that is greater than or equal to the auction price as evidence that an auction was held and as to the validity of the refunded bid amount. Additional proof can also be provided, such as identification binding the hash receipts to the same auction in which the customer's bid amount was applied. In the event that the repudiation challenge is successful, the resource provider may respond by providing a new refunded bid amount, such as if the original request had not been received and so had not been entered into an auction.

Various other functions and advantages are described and suggested below as may be provided in accordance with the various embodiments.

FIG. 1 illustrates an example environment 100 that can be used in accordance with various embodiments. In this example, an electronic device 102 for an end user, which can include any appropriate device operable to send and receive requests, messages, or information over a network 104 into a multi-tenant environment 106 to perform a task, such as to process a workload, provision a data repository, or perform another such task. Examples of such client devices include personal computers, cell phones, handheld messaging devices, laptop computers, set-top boxes, personal data assistants, electronic book readers, and the like. While an end user computing device is used for purposes of explanation, it should be understood that any appropriate user, application, service, device, component, or resource can access components of the multi-tenant environment as appropriate in the various embodiments. Further, the network can be any appropriate wired and/or wireless network (s), such as a local area network (LAN), the Internet, an intranet, a cellular network, or any other such network or combination thereof.

The multi-tenant environment 106 in this example can be provided by what will be referred to herein as a resource provider. A request sent to the multi-tenant environment can be received to a network layer 108, such as a Web services layer or tier, which can include a number of components used for receiving and managing network traffic, as may include at least one Web server, for example, along with computer-executable software, application servers, or other such components. The network layer can include a set of APIs (or other such interfaces) for receiving requests (e.g., Web service calls) from across the network 104. Each API can be provided to receive requests for at least one specific action to be performed with respect to the multi-tenant environment, a specific type of resource to be accessed, etc. Upon receiving a request to one of the APIs, the network layer can parse or otherwise analyze the request to determine the steps or actions needed to process the request.

A network layer 108 in one embodiment includes a scalable set of customer-facing servers that can provide the various APIs and return the appropriate responses based on the API specifications. The network layer also can include at least one API service layer that in one embodiment consists of stateless, replicated servers which process the externally-facing customer APIs. The network layer can be responsible for front end features such as authenticating customers based on credentials, authorizing the customer, and validating user input. In many embodiments, the network layer and/or API service layer will be the only externally visible component, or the only component that is visible to, and accessible by, various customers. The servers of the network layer can be stateless and scaled horizontally as known in the art.

In at least some embodiments, customer requests that require access to one or more resources in the multi-tenant environment can be directed to a resource manager 110. The resource manager can be one or more components provided in hardware and/or software, and can be responsible for tasks such as managing and provisioning physical and/or virtual resources and resource instances. In this example, the multi-tenant environment includes different types of resources, such as may include various types of data stores 114 and computing resources 112, such as servers and the like. The resource manager 110 can determine the type of resource(s) needed to process a request, the availability of the resource(s), and the ability of the customer to obtain access to the resource(s). This can include, for example, determining permissions of one or more resources, determining a type of the user or a type of request, etc. In addition, the resource manager 110 can also be configured to determine when to allow the request to be processed during periods of contention for the resource(s).

In this example, the resource manager 110 is in communication with a auction manager 116, which can also be implemented through a combination of hardware and software, such as an application or module executing on one or more computing devices. For example, the auction manager 116 can be an application or service executing on one or more servers in the multi-tenant environment. In some situations, the resource manager 110 may determine that there are more requests than can be processed by the resource(s) at particular times. The resource manager 110 can assess the current amount of capacity of the resource(s) to determine the number of requests M that can be processed within the given time. The resource manager 110 can then contact the auction manager 116, which in turn may evaluate the bid amounts of each of the requests received during this period of time to determine a winning bid amount.

In at least some embodiments, a Vickrey auction or a variation thereof can be implemented to determine the auction price. Some of the advantages of a Vickrey auction are that it is decentralized, non-iterative, and efficient. It is decentralized because there may be no need for a central planner as bidders can make decisions about pricing based on their own valuation of immediate access to a shared resource. The Vickrey auction is non-iterative in that the auction may conclude after a single round, which reduces the number of round-trip communications that are typical of other types of auctions. The Vickrey auction is also efficient because the dominant strategy is for bidders to bid the true valuation for a shared resource, thus bidders are disincentivized from trying to game the auction. In this example, auction manager 116 employs a Vickrey auction to analyze each of the bid amounts to determine the winning bid amount, such as the $M+1^{St}$ bid amount or the midpoint between the $M^{th}$ and $M+1^{St}$ bid amounts, etc. Each of the incoming requests including a bid amount that is greater than the winning bid amount may be selected for processing, and the other requests can be queued until another auction is conducted or the other requests can be dropped depending on various implementations. The auction manager 116 may also provide refunded bid amounts included in a response to each of the selected requests, such as the difference between the determined winning bid amount and the bid amount of the selected request.

In some embodiments, the resource manager 110 may perform tie-breaking procedures, round bid amounts, or make other simplifications to reduce the latency associated with the auction process, such as by evaluating bid amounts in a probabilistic, approximate, or sampling fashion. For example, if 100,000 requests are received with various bid amounts, and it is determined that a shared resource can only process 10,000 requests at a given time, the resource manager may select approximately the 10,000 requests with the highest bids using an auction price less than the smallest bid amount of any selected request. The resource manager may perform the approximate selection by, for example, partitioning incoming requests into ten roughly equal-sized piles, analyzing the piles in parallel, and selecting the top 1,000 requests from each pile to avoid having to order all 100,000 requests iteratively.

Figure 2:
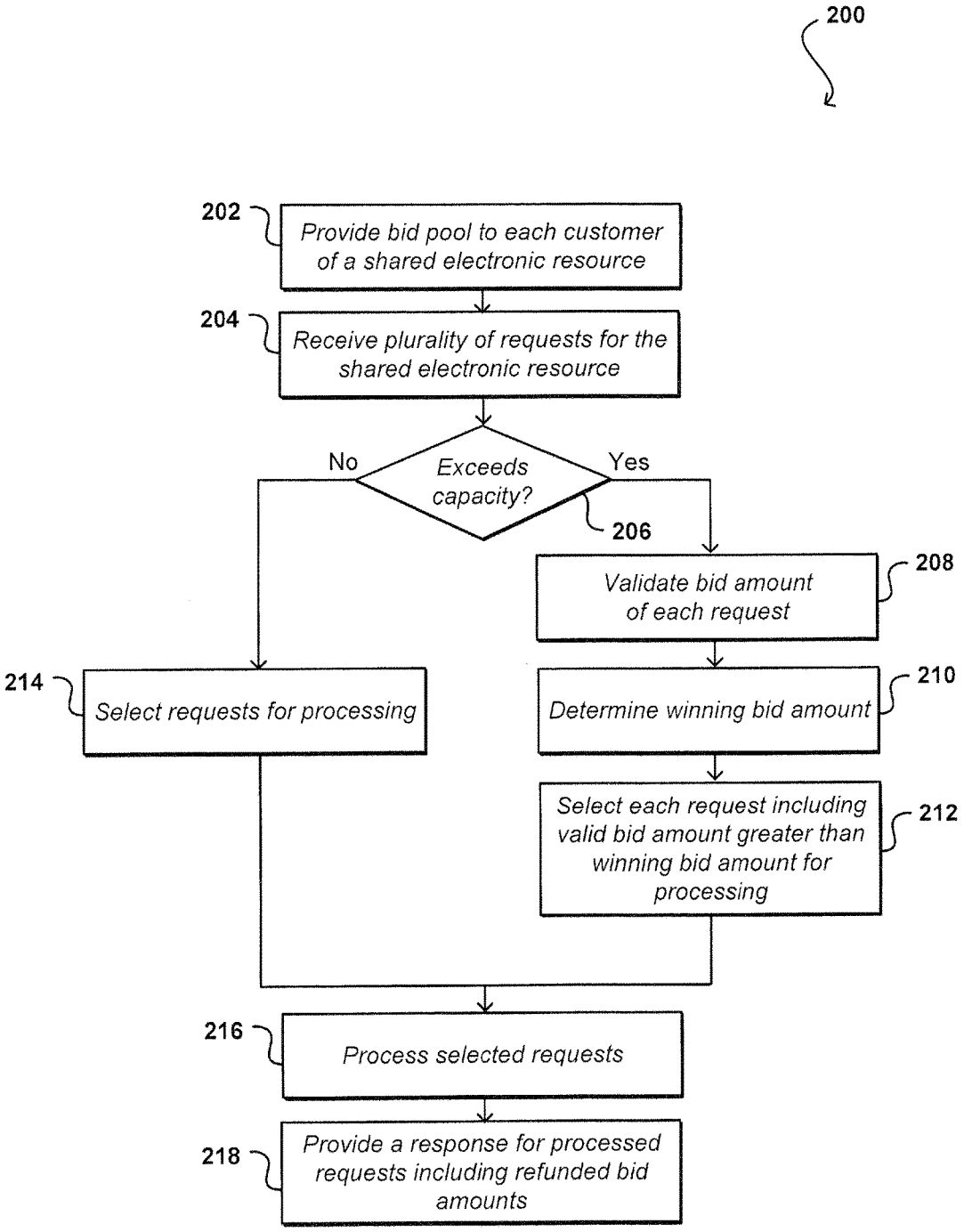
FIG. 2 illustrates an example process for managing access to shared electronic resources that can be used in accordance with various embodiments.

FIG. 2 illustrates an example process 200 that can be utilized to determine an order for access to shared electronic resources in accordance with various embodiments. It should be understood that there can be additional, fewer, or alternative steps performed in similar or alternative orders, or in parallel, within the scope of the various embodiments unless otherwise stated. In this example, a bid pool is provisioned to each customer of a shared resource 202. The bid pool may comprise a number of bid units, and each bid unit may be a fixed value or may be divided into smaller units, e.g., tenths or hundredths. In some embodiments, each customer may be allocated a bid pool with a common number of bid units upon registration for usage of a shared electronic resource and each bid pool may be replenished periodically. Alternatively, or in addition, customers may be able to obtain additional bid units, such as by purchase. For example, the customer may purchase an hour's time for an electronic resource. At each minute during the hour, the customer may receive bid units whose amount is determined by the cost of the electronic resource. In some embodiments, the bid pool may grow in a non-linear fashion, which may result in diminishing returns after a cap value so as to prevent customers from accumulating arbitrarily large amounts of bid units. In other embodiments, customers may be able to purchase bid pools with varying cap values.

Customer requests for the shared electronic resource will be received periodically 204. On certain occasions, it will be estimated that the shared electronic resource lacks the capacity (e.g., processing capacity, storage, and/or network bandwidth) to process all of the incoming customer requests 206. If so, an auction can be held to determine which of the customer requests will be queued for processing. The auctioning may involve validation of the bid amount of each request 208. For example, as will be discussed in further detail below, a request may include information such as data representing previous contents of a customer's bid pool, one or more attestations certifying the validity of the previous contents, data representing current contents of the customer's bid pool, and a hash receipt of the data and the attestation(s). Validation may include confirming that the data and the attestation(s) match with the hash receipt, ensuring that the hash receipt has not previously been entered successfully in an earlier auction, verifying the attestation(s), etc.

A winning bid amount can then be determined according to valid bid amounts 210, and each request including a valid bid amount greater than or equal to the determined winning bid amount may be selected for processing 212. Various approaches can be used for handling those requests that are not selected for processing, i.e., those requests having bids below the winning bid amount and "losing" the auction. In some embodiments, a queue that is separate from a processing queue can be used to order losing bids according to when the request corresponding to the losing bid was received. At the next auction, losing bids may be weighted to combine a congestion pricing approach and a fair ordering approach for resource allocation. For example, losing bids may be adjusted incrementally (e.g., each losing bid may be increased by a value of 0.50) or by another factor as is known in the art (e.g., linearly, exponentially, logarithmically, etc.) without "charging" the customer or requiring the customer to withdraw that amount from the customer's bid pool. Various weighting approaches can be used in alternative embodiments depending on the extent to which of the two approaches is to be emphasized. Durations between auctions can depend on factors such as the rate at which requests are being received from customers, a system's intake capacity, system memory for queuing requests selected for processing and requests not selected for processing, and other considerations known to one of ordinary skill in the art. In one embodiment, auctions are held every minute when a resource estimates that the number of incoming requests exceeds its capacity and unselected requests are queued for five minutes before the unselected request is dropped. In another embodiment, instead of dropping requests after five minutes, unselected requests associated with, for example, a certain level of service or quality of service (QOS) can be guaranteed to be selected for processing after being queued for five minutes. In yet another embodiment, unselected requests are not queued at all and are instead discarded immediately so that the customer becomes aware of congestion and can respond accordingly, such as increasing a bid amount or waiting until there is less contention or no contention for the resource.

In some embodiments, a shared resource or an associated auction manager can implement a hysteresis condition with respect to conducting auctions. For example, an auction can be held every minute for at least five minutes after the end of the period of congestion when the shared resource estimates that it is has sufficient capacity to process incoming requests. The five minute duration can be reset if during those five minutes the resource again estimates that its capacity has been exceeded. It will be appreciated that different periods of time (e.g., time between auctions, queue time, hysteresis periods) can be used in various embodiments according to the considerations discussed herein and/or as is known in the art, and the periods of time provided herein are for explanatory purposes and should not be construed as limitations on the various embodiments.

Another way of handling unselected requests may be thought of as providing an n-chance auction wherein unselected requests are queued according to bid value for participation in the next auction. Unselected requests may be queued for n number of auctions before the request is dropped. In some embodiments, the unselected requests may participate in the next auction without re-weighting. In other embodiments, the unselected requests can be weighted based on how long the request has been queued using one of the weighting techniques discussed herein and/or known in the art.

In some embodiments, the resource provider may support requests with zero bid amounts. For example, in one embodiment, the resource provider may treat a request without a valid hash receipt as having a bid amount of zero. In another embodiment, the resource provider may permit a customer to create a hash receipt for a bid amount of zero to be created without requiring an attestation for the customer's bid pool. In certain situations, the shared resource may have sufficient capacity to process all requests including a non-zero bid amount as well as some requests including bid amounts of zero. Under these circumstances, requests including bid amounts of zero may be selected based on the order that such requests were received. The winning bid amount can then be calculated as the second lowest non-zero bid amount, the lowest non-zero bid amount, the midpoint of the second lowest non-zero bid amount and lowest non-zero bid amount, or some fraction of the lowest non-zero bid amount, such as half, if divisible bid units are supported.

When a shared resource has capacity to process all incoming requests, all of the requests can be selected for processing 214. Requests that are selected for processing may be queued and then processed by the shared resource 216, such as in order of descending bid amounts, in order a request was received, or similar approaches discussed herein and/or known in the art. The resource provider may then calculate a refunded bid amount, if any, based on the bid amount associated with a request and the determined winning bid amount. Customers whose requests were selected for processing may be provided a response with a refunded bid amount 218. Preferably, the resource provider will piggyback the refunded bid amount on an existing acknowledgment or response to avoid creating additional communication overhead.

In various embodiments, committed withdrawals from bid pools can be segregated from the auctioning process, and thus, bid pool transformations can be decentralized. Such approaches can minimize the additional latency and multiple round trip-communications that may be required of a conventional centralized currency system or a conventional system that integrates auctioning and committed currency withdrawals. To accomplish separation of auction processing and bid pool withdrawals, customers may irreversibly withdraw bid units from their bid pools prior to participating in the auction. Customers may make such irreversible transactions by generating a cryptographic hash receipt for withdrawn bid units and transforming their bid pools to incorporate the hash receipt into a non-repudiable cryptographically signed tree representing their bid pool contents. Bid pools may be transformed by determining signatures of the prior contents of a bid pool and new contents of the bid pool, such as after withdrawal of bid units, and obtaining attestations for the signature of the prior contents of the bid pool from a trusted authority. Customers may then bid on access to a shared resource by attaching the hash receipt to a request to the resource provider.

Figure 3:
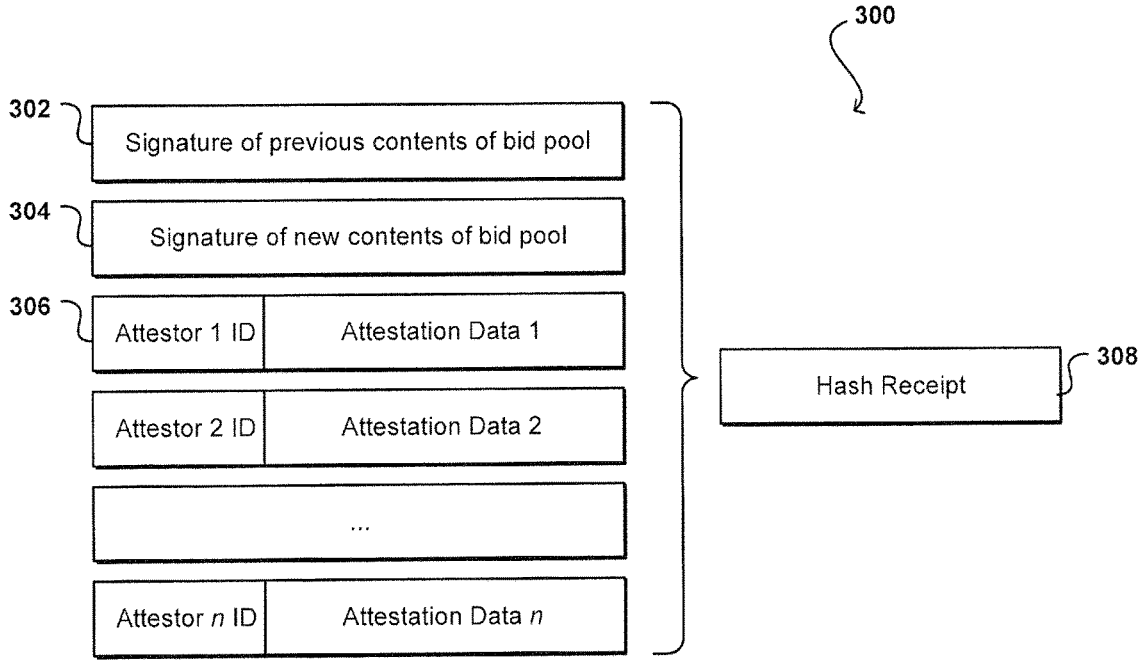
FIG. 3 illustrates an example of components of a request that can be used in accordance with various embodiments.

FIG. 3 illustrates an example of components of a request that can be used in accordance with various embodiments. In this example, depicted are a signature of the previous contents of customer's bid pool 302 and a signature of the current contents of the bid pool 304. The signatures may be generated using a public-key cryptography algorithm such as RSA, Digital Signature Algorithm (DSA), Elliptic Curve Cryptography (ECC), Rabin, ElGamal, McEliece, Cramer-Shoup, LUC, or other encryption schemes known to those of ordinary skill in the art. To generate each of the signatures, the plaintext contents of the customer's bid pool can be encrypted using the customer's private signature key, and the plaintext can be recovered, such as by the resource provider or a trusted authority, using the customer's public signature key. The signatures 302 and 304 are sent to a trusted authority to obtain one or more attestations 306 that the customer's bid pool has not been modified from the first signature 302. For example, an attestation by a trusted authority indicates that the trusted authority has not previously certified a signature for the customer that is newer than signature 302. In such circumstances, the trusted authority may provide an attestation 306 that may include self-identifying information and attestation data such as the trusted authority's signature of the signature 302, plaintext of the previous contents of the customer's bid pool, or other plaintext binding the trusted authority to the customer's signature 302. The trusted authority will then record signature 304, and will refuse to provide the customer an attestation of any signature older than signature 304. In various embodiments, the attestation(s) may be received from the resource provider, a trusted third party, other customers of the shared resource, other customers of a shared multi-tenant environment. In embodiments where the trusted authority comprises a plurality of third parties, the resource provider may randomly select the third parties to act as an observing set. The customer's signature 302 will not be valid unless at least a majority of the observing set each provides an attestation. In some embodiments, the resource provider may periodically change the membership of an observing set. In situations where an observer has not previously certified the contents of the customer's bid pool, the observer may demand proof that the customer obtained attestations from at least a majority of the observing set for the bid pool transformation immediately prior to the current transformation.

Once the customer has obtained a sufficient number of attestations, the customer may calculate a transformation hash receipt 308 based at least in part upon the signature 302, signature 304, and the one or more attestations 306. The transformation hash receipt 308 can be determined using a hash algorithm such as Message Digest (MD) (e.g., MD2, MD4, MD5), Secure Hash Algorithm (SHA) (e.g., SHA-1, SHA-2, SHA-224, SHA-256, SHA-384, SHA-512), RIPEMD (e.g., RIPEMD-160, RIPEMD-256, RIPEMD-320, RIPEMD-128), HAVAL, Whirlpool, Tiger (e.g., Tiger/192, Tiger/128, Tiger/160), or other hash algorithms known to those of ordinary skill in the art. The customer may attach the transformation receipt 308 to a request for a shared resource in a message or request protocol header, such as a Hypertext Transfer Protocol (HTTP) header, Simple Object Access Protocol (SOAP) header, or as part of a Multipurpose Internet Mail Extensions (MIME) multipart message. In addition, the customer may sign the request contents, including the header, to cause the transformation hash receipt to be non-repudiable. For example, a customer may calculate a transformation hash receipt value of '0x89abcdef' from the signatures of the previous and new contents of the customer's bid pool and the one or more attestations. The customer can add an HTTP header 'X-BID-POOL: 0x89abcdef' to an HTTP request for the shared resource. Then a signature for the request, including the X-BID-POOL header, can be calculated using the customer's private signature key. The customer may then attach the signature to the request as part of a MIME multipart/related message. In various embodiments, where the size of the signature does not exceed a specified size for a protocol header, the signature may be included as another header, e.g., X-BID-SIGNATURE. The customer may send the signed message to the resource provider. In some embodiments a timestamp, a name of the request being made, or other identification binding the bid amount to a specific request may be included in the transformation hash receipt or the message signature. Although an HTTP request is discussed in this example, it will be appreciated that the approaches discussed herein can be implemented over a variety of network communication protocols depending on how a resource is configured to accept requests. For example, various embodiments may be applied using other protocols of the application layer of the Open Systems Communication (OSI) model, such as HTTPS, File Transfer Protocol (FTP), Simple Mail Transfer Protocol (SMTP), or protocols overlaying these. In addition, approaches in accordance various embodiments can also be applied for lower-level protocols of the OSI stack, such as the Transmission Control/Internet Protocol (TCP/IP) or User Datagram Protocol (UDP). Further, the techniques discussed herein are not limited to the OSI model, but can be implemented over Bluetooth®, Radio Frequency (RF), Near Field Communications (NFC), a cellular network, etc. For example, certain resources may be requested by Short Message Service (SMS) texting or a proprietary protocol overlaying SMS and various embodiments can be configured for requesting access to such resources.

When a resource provider receives such a request and an auction is conducted to determine which requests will be selected for processing, the resource provider may evaluate the request by extracting the transformation receipt 308 from the X-BID-POOL header and the data associated with the transformation from the message body, such as the signatures 302 and 304 and the attestation(s) 306. In some embodiments, the resource provider may verify that the transformation receipt 308 has not already been applied to a previous auction. For example, the resource provider may require that the contents of the customer's bid pool be attested to within a certain period of time when used to bid on a request, such as fifteen minutes, and the transformation receipt may be cached for an equal period of time to prevent the customer from firing up multiple requests using the same transformation receipt within a short period of time. The resource provider may examine each of the attestations to ensure that they were time-stamped within the proper amount of time. In addition, in the example of FIG. 3 where attestations comprised at least the identification of an observer and an encryption of plaintext binding the observer to the customer request, the attestations can be quickly verified by decrypting the attestation data using the observer's public key. The resource provider may also validate that the correct set of observers were used to provide attestations based on the time-stamp and the identifications of the observers. Further, the resource provider can also ensure that at least a majority of an observing set provided attestations.

Figure 4:
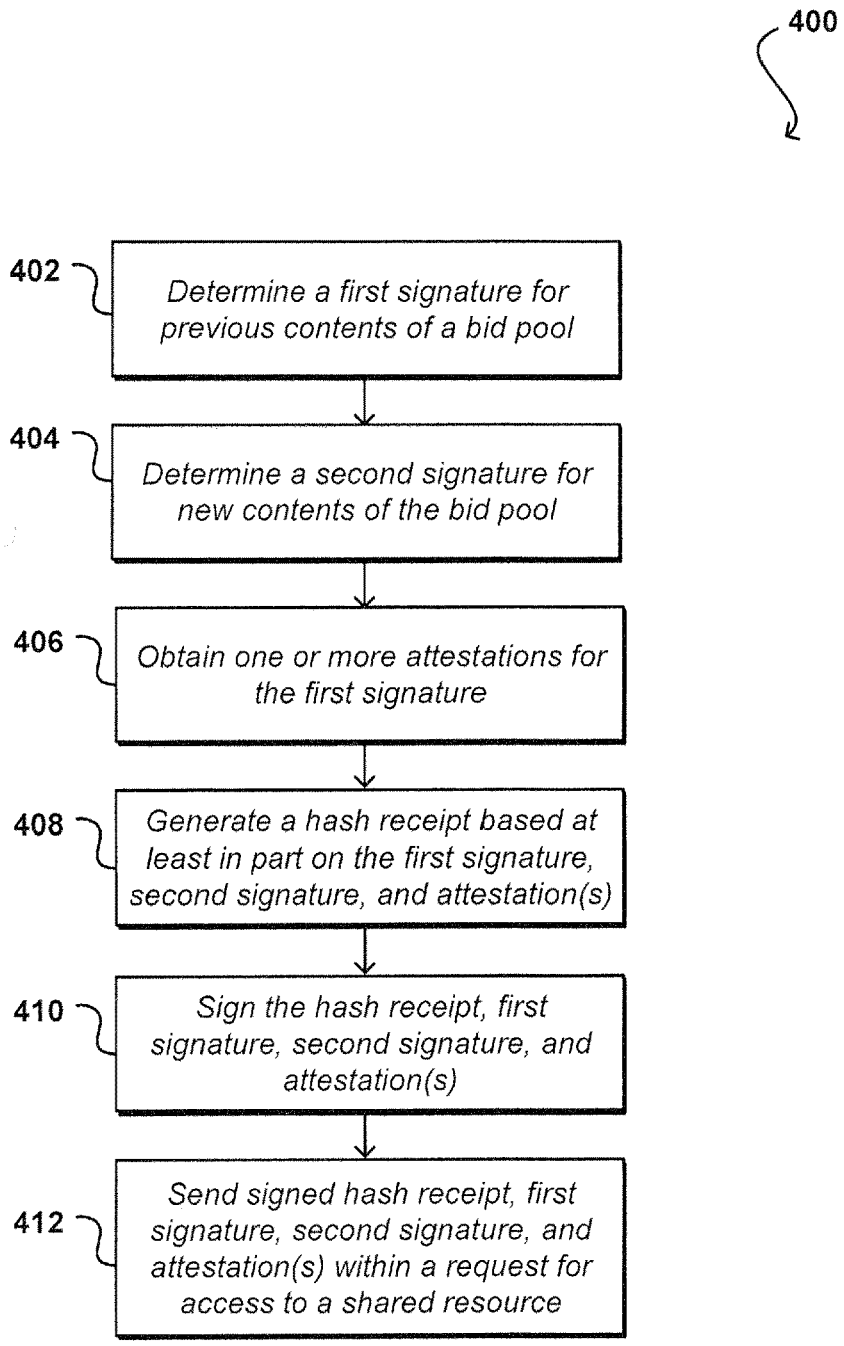
FIG. 4 illustrates an example process for transforming a bid pool that can be used in accordance with various embodiments.

FIG. 4 illustrates an example process 400 that can be utilized by a customer to request for access to a shared electronic resource. In addition, at least a portion of the process 400 can be employed to add bid amounts to the customer's bid pool, such as adding refunded bid amounts or purchased bid units. In this example, a first signature for the previous contents of a bid pool may be determined 402, and a second signature for new contents of the bid pool may also be determined 404. One or more attestations may be obtained 406 from a trusted authority to verify that the trusted authority is not aware of any signature older than the first signature, i.e., that the customer has not tried to modify the contents of the bid pool since the first signature from the perspective of the trusted authority. In addition, the trusted authority will record the second signature as the contents of the customer's bid pool from that point on. When the transformation would result in an increase in the customer's bid pool, additional proof can be provided to the trusted authority. For example, the resource provider may sign a refunded bid amount or purchased bid units using the resource provider's private signature key and the trusted authority may verify the signature using the resource provider's public signature key. A hash algorithm may be performed on the first signature, second signature, and attestation(s) to generate a hash receipt for the transformation data 408. The customer may generate a signature for at least the hash receipt, first signature, second signature, and attestation(s) 410. The customer may then incorporate the hash receipt into a request for access to a shared electronic resource and send the request to the resource provider 412. When the customer merely wants to update the customer's bid pool, such as when the customer receives a refunded bid pool amount or otherwise obtains additional bid units, the customer may broadcast the signature to a trusted authority to update the contents customer's bid pool.

Figure 5:
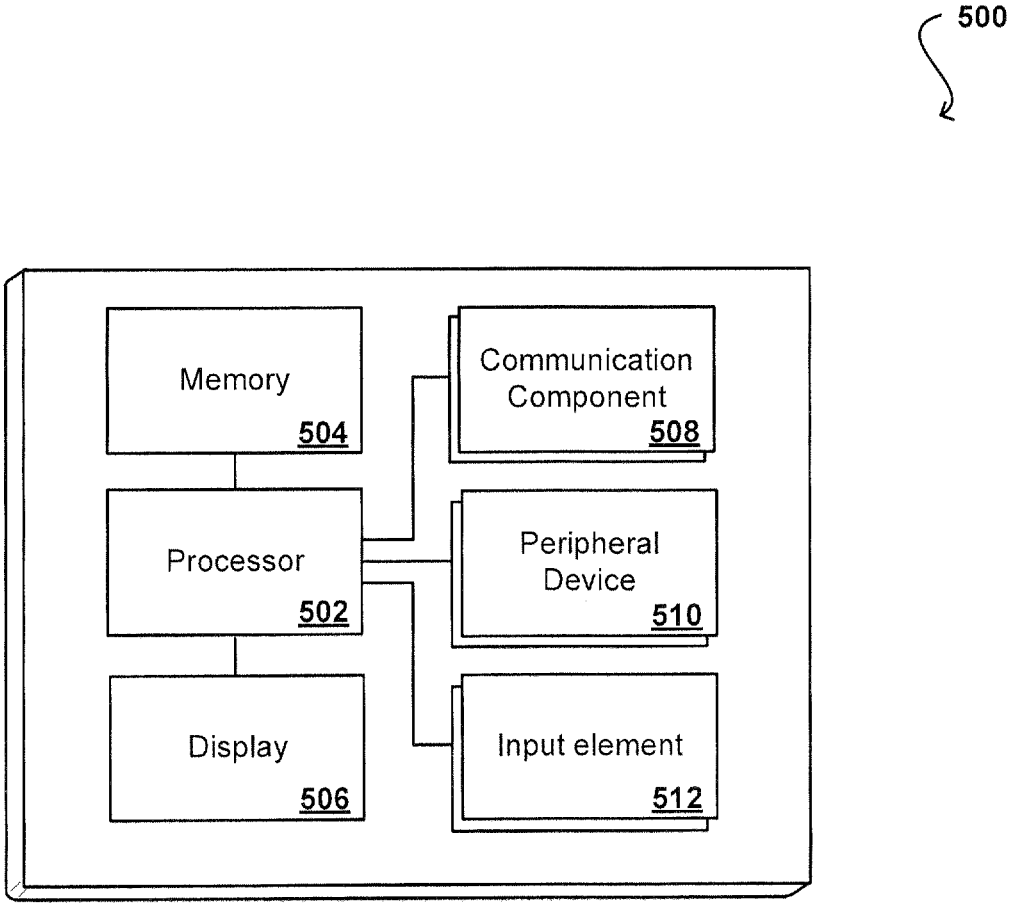
FIG. 5 illustrates a set of components of an example computing device that can be utilized in accordance with various embodiments.

FIG. 5 illustrates a logical arrangement of a set of general components of an example computing device 500 that can be utilized in accordance with various embodiments. In this example, the device includes a processor 502 for executing instructions that can be stored in a memory device or element 504. As would be apparent to one of ordinary skill in the art, the device can include many types of memory, data storage, or non-transitory computer-readable storage media, such as a first data storage for program instructions for execution by the processor 502, a separate storage for images or data, a removable memory for sharing information with other devices, etc. The device typically will include some type of display element 506, such as a touch screen or liquid crystal display (LCD), although devices such as portable media players might convey information via other means, such as through audio speakers.

In some embodiments, the computing device 500 can include one or more communication components 508, such as a network, Wi-Fi, Bluetooth, RF, wired, or wireless communication system. The device in many embodiments can communicate with a network, such as the Internet, and may be able to communicate with other such devices. In some embodiments the device can include at least one additional input device 512 and/or peripheral device 510 able to receive and/or process conventional input. This conventional input can be provided by, for example, a push button, touch pad, touch screen, wheel, joystick, keyboard, mouse, keypad, or any other such device or element whereby a user can input a command to the device. In some embodiments, however, such a device might not include any buttons at all, and might be controlled only through a combination of visual and audio commands, such that a user can control the device without having to be in contact with the device.

As discussed above, the various embodiments can be implemented in a wide variety of operating environments, which in some cases can include one or more user computers, computing devices, or processing devices which can be used to operate any of a number of applications. User or client devices can include any of a number of general purpose personal computers, such as desktop or laptop computers running a standard operating system, as well as cellular, wireless, and handheld devices running mobile software and capable of supporting a number of networking and messaging protocols. Such a system also can include a number of workstations running any of a variety of commercially-available operating systems and other known applications for purposes such as development and database management. These devices also can include other electronic devices, such as dummy terminals, thin-clients, gaming systems, and other devices capable of communicating via a network.

Various aspects also can be implemented as part of at least one service or Web service, such as may be part of a service-oriented architecture. Services such as Web services can communicate using any appropriate type of messaging, such as by using messages in extensible markup language (XML) format and exchanged using an appropriate protocol such as SOAP (derived from the "Simple Object Access Protocol"). Processes provided or executed by such services can be written in any appropriate language, such as the Web Services Description Language (WSDL). Using a language such as WSDL allows for functionality such as the automated generation of client-side code in various SOAP frameworks.

Most embodiments utilize at least one network that would be familiar to those skilled in the art for supporting communications using any of a variety of commercially-available protocols, such as TCP/IP, OSI, FTP, UPnP, NFS, CIFS, and AppleTalk. The network can be, for example, a local area network, a wide-area network, a virtual private network, the Internet, an intranet, an extranet, a public switched telephone network, an infrared network, a wireless network, and any combination thereof.

In embodiments utilizing a Web server, the Web server can run any of a variety of server or mid-tier applications, including HTTP servers, FTP servers, CGI servers, data servers, Java servers, and business application servers. The server(s) also may be capable of executing programs or scripts in response requests from user devices, such as by executing one or more Web applications that may be implemented as one or more scripts or programs written in any programming language, such as Java®, C, C# or C++, or any scripting language, such as Perl, Python, or TCL, as well as combinations thereof. The server(s) may also include database servers, including without limitation those commercially available from Oracle®, Microsoft®, Sybase®, and IBM®.

The environment can include a variety of data stores and other memory and storage media as discussed above. These can reside in a variety of locations, such as on a storage medium local to (and/or resident in) one or more of the computers or remote from any or all of the computers across the network. In a particular set of embodiments, the information may reside in a storage-area network ("SAN") familiar to those skilled in the art. Similarly, any necessary files for performing the functions attributed to the computers, servers, or other network devices may be stored locally and/or remotely, as appropriate. Where a system includes computerized devices, each such device can include hardware elements that may be electrically coupled via a bus, the elements including, for example, at least one central processing unit (CPU), at least one input device (e.g., a mouse, keyboard, controller, touch screen, or keypad), and at least one output device (e.g., a display device, printer, or speaker). Such a system may also include one or more storage devices, such as disk drives, optical storage devices, and solid-state storage devices such as random access memory ("RAM") or read-only memory ("ROM"), as well as removable media devices, memory cards, flash cards, etc.

Such devices also can include a computer-readable storage media reader, a communications device (e.g., a modem, a network card (wireless or wired), an infrared communication device, etc.), and working memory as described above. The computer-readable storage media reader can be connected with, or configured to receive, a computer-readable storage medium, representing remote, local, fixed, and/or removable storage devices as well as storage media for temporarily and/or more permanently containing, storing, transmitting, and retrieving computer-readable information. The system and various devices also typically will include a number of software applications, modules, services, or other elements located within at least one working memory device, including an operating system and application programs, such as a client application or Web browser. It should be appreciated that alternate embodiments may have numerous variations from that described above. For example, customized hardware might also be used and/or particular elements might be implemented in hardware, software (including portable software, such as applets), or both. Further, connection to other computing devices such as network input/output devices may be employed.

Storage media and computer readable media for containing code, or portions of code, can include any appropriate media known or used in the art, including storage media and communication media, such as but not limited to volatile and non-volatile, removable and non-removable media implemented in any method or technology for storage and/or transmission of information such as computer readable instructions, data structures, program modules, or other data, including RAM, ROM, EEPROM, flash memory or other memory technology, CD-ROM, digital versatile disk (DVD) or other optical storage, magnetic cassettes, magnetic tape, magnetic disk storage or other magnetic storage devices, or any other medium which can be used to store the desired information and which can be accessed by the a system device. Based on the disclosure and teachings provided herein, a person of ordinary skill in the art will appreciate other ways and/or methods to implement the various embodiments.

The specification and drawings are, accordingly, to be regarded in an illustrative rather than a restrictive sense. It will, however, be evident that various modifications and changes may be made thereunto without departing from the broader spirit and scope of the invention as set forth in the claims.

What is claimed is:

1. A computer-implemented method comprising:

calculating a first signature including at least current contents of a bid pool for bidding on access to at least one shared electronic resource in a multi-tenant environment;

determining a bid amount to withdraw from the bid pool to transform the bid pool from the current contents to new contents;

calculating a second signature for the new contents;

verifying, via a trusted authority, that the current contents are in accordance with the first signature, wherein verifying via a trusted authority comprises:

comparing the first signature with prior issued signatures of the trusted authority to determine that no prior issued signatures match the first signature, and generating an attestation upon determining that no prior issued signatures match the first signature;

generating a hash receipt based at least in part upon the first signature, the second signature, and the attestation;

calculating a third signature based at least in part upon the hash receipt, wherein the first signature, the second signature and the third signature are calculated from a cryptography algorithm for calculating unique signatures; and processing, on the at least one shared electronic resource, a computing task, wherein the access to the at least one shared electronic resource is enabled based at least in part on the third signature and the hash receipt.

2. The computer-implemented method of claim 1, further comprising:

providing a response including at least information indicating a result of the at least one shared electronic resource performing the at least one computing task and a refunded bid amount when the bid amount is greater than a winning bid amount determined in an auction for the access to the at least one shared electronic resource.

3. The computer-implemented method of claim 2, further comprising:

calculating a fourth signature of updated current contents of the bid pool in response to the access enabled for the at least one shared resource;

calculating a fifth signature of updated new contents of the bid pool based at least in part upon the updated current contents of the bid pool and the refunded bid amount; and verifying, via the trusted authority and using the fourth and fifth signatures, that the updated current contents are in accordance with the second signature, wherein the verification that the updated current contents are in accordance with the second signature causes transformation of the updated current contents to the updated new contents.

4. A computer-implemented method comprising:

generating first data corresponding to first contents of a resource pool for access to at least one resource;

generating second data corresponding to second contents of the resource pool, the second data including information corresponding to an amount withdrawn from the resource pool;

verifying, via a trusted authority, that the first data accurately reflect the first contents of the resource pool, wherein verifying via a trusted authority comprises:

comparing the first data with prior data generated from each prior resource pool, to determine that no prior data match the first data, and generating an attestation upon determining that no prior data match the first data;

generating third data based at least in part upon the first data, the second data, and the attestation, wherein the first data, the second data, and the third data are generated from a cryptography algorithm, the cryptography algorithm for generating unique data; and processing, on the at least one resource, a computing task, wherein the access to the at least one resource is enabled based at least in part on the third data.

5. The computer-implemented method of claim 4, wherein the trusted authority comprises at least one of a resource provider providing the access to the at least one resource or one or more third parties, the attestation being obtained from at least a majority of the trusted authority.

6. The computer-implemented method of claim 4, further comprising:

calculating a first signature including at least the first contents of the resource pool, the first data including at least the first signature.

7. The computer-implemented method of claim 4, further comprising:

calculating a second signature including at least the second contents of the resource pool, the second data including at least the second signature.

8. The computer-implemented method of claim 4, wherein the third data comprises at least information identifying each entity providing the attestation and a respective signature of each entity.

9. The computer-implemented method of claim 4, further comprising:

generating a hash receipt based at least in part upon the first data, the second data, and the third data, wherein the access to the at least one resource is further based in part on the hash receipt.

10. The computer-implemented method of claim 9, further comprising:

calculating a signature based at least in part upon the hash receipt, wherein the access to the at least one resource is further based in part on the signature.

11. The computer-implemented method of claim 4, further comprising:

receiving a response to a request for the access to the at least one resource, the response including at least information indicating a result of the access to the at least one resource and a new amount to deposit to the resource pool when the amount withdrawn from the resource pool is greater than demanded for the access to the at least one resource.

12. The computer-implemented method of claim 11, further comprising:

generating fourth data corresponding to third contents of the resource pool in response to the access enabled for the at least one shared resource;

generating fifth data corresponding to fourth contents of the resource pool, the fifth data based at least in part upon the new amount; and verifying, via the trusted authority and using the fourth and fifth data, that the third contents are in accordance with the second signature, wherein the verification that the third contents are in accordance with the second signature causes transformation of the third contents to the fourth contents.

13. The computer-implemented method of claim 11, further comprising:

providing a response to the second request, the response including at least first information indicating a first result of the access to the at least one resource, second information indicating a second result of second access to at least one second resource, and the new amount to deposit to the resource pool when the amount withdrawn from the resource pool is greater than demanded in aggregate for the access to the at least one resource and the second access to the at least one second resource.

14. The computer-implemented method of claim 11, further comprising:

sending a third request prior to receiving a first response to the request for the new amount to deposit to the resource pool when the amount withdrawn from the resource pool is greater than demanded for the access to the at least one resource.

15. The computer-implemented method of claim 11, further comprising:

sending a repudiation challenge regarding the new amount to deposit to the resource pool;

receiving a first repudiation response including at least information validating the new amount when the new amount is determined to be valid; and receiving a second repudiation response including the amount withdrawn from the resource pool when the new amount is determined to be invalid.

16. A computing system, comprising:

at least one processor; and at least one memory device including instructions that, when executed by the at least one processor, enable the computing system to:

generate first data corresponding to first contents of a resource pool for access to at least one resource;

generate second data corresponding to second contents of the resource pool, the second data including information corresponding to an amount withdrawn from the resource pool;

verify, via a trusted authority, that the first data accurately reflect the first contents of the resource pool, wherein verifying via a trust authority comprises:

compare the first data with prior data of the resource pool to determine that no prior data match the first data, and generate an attestation upon determining that no prior data match the first data;

generate third data based at least in part upon the first data, the second data, and the attestation, wherein the first data, the second data, and the third data are generated from a cryptography algorithm, the cryptography algorithm for generating unique data; and process, on the at least one resource, a computing task, wherein the access to the at least one resource is enabled based at least in part on the third data.

17. The computing system of claim 16, wherein the trusted authority comprises at least one of a resource provider providing the access to the at least one resource or one or more third parties, the attestation being obtained from at least a majority of the trusted authority.

18. The computing system of claim 16, wherein the instructions when executed by the at least one processor further enable the computing system to:

calculate a first signature including at least the first contents of the resource pool, the first data including at least the first signature.

19. The computing system of claim 16, wherein the instructions when executed by the at least one processor further cause the computing system to:

calculate a second signature including at least the second contents of the resource pool, the second data including at least the second signature.

20. The computing system of claim 16, wherein the third data comprises at least information identifying each entity providing the attestation and a respective signature of each entity.

21. The computing system of claim 16, wherein the instructions when executed by the at least one processor further cause the computing system to:

generate a hash receipt based at least in part upon the first data, the second data, and the third data, wherein the access to the at least one resource is further based in part on the hash receipt.

22. The computing system of claim 21, wherein the instructions when executed by the at least one processor further cause the computing system to:

calculate a signature based at least in part upon the hash receipt, wherein the access to the at least one resource is further based in part on the signature.

23. The computing system of claim 16, wherein the instructions when executed by the at least one processor further cause the computing system to:

receive a response to a request for the access to the at least one resource, the response including at least information indicating a result of the access to the at least one resource and a new amount to deposit to the resource pool when the amount withdrawn from the resource pool is greater than demanded for the access to the at least one resource.

24. The computing system of claim 23, wherein the instructions when executed by the at least one processor further cause the computing system to:

generate fourth data corresponding to third contents of the resource pool in response to the access enabled for the at least one shared resource;

generate fifth data corresponding to fourth contents of the resource pool, the fifth data based at least in part upon the new amount; and verify, via the trusted authority and using the fourth and fifth data, that the third contents in accordance with the second signature, wherein the verification that the third contents are in accordance with the second signature causes transformation of the third contents to the fourth contents.

25. The computing system of claim 16, wherein the instructions when executed by the at least one processor further cause the computing system to:

provide a response to the second request, the response including at least first information indicating a first result of the access to the at least one resource, second information indicating a second result of second access to at least one second resource, and the new amount to deposit to the resource pool when the amount withdrawn from the resource pool is greater than demanded in aggregate for the access to the at least one resource and the second access to the at least one second resource.

* * * * *